US005326742A

United States Patent [19]

Kushi et al.

[11] Patent Number: 5,326,742

[45] Date of Patent: Jul. 5, 1994

[54] RECORDING MEDIUM FOR SUBLIMATION TYPE HEAT-SENSITIVE TRANSFER RECORDING PROCESS

[75] Inventors: Kenji Kushi; Takayuki Iseki; Tadayuki Fujiwara; Kazuhiko Jufuku; Akifumi Ueda, all of Hiroshima, Japan

[73] Assignee: Mitsubishi Rayon Co., Ltd., Tokyo, Japan

[21] Appl. No.: 22,298

[22] Filed: Feb. 25, 1993

[30] Foreign Application Priority Data

| | | | |
|---|---|---|---|
| Feb. 25, 1992 | [JP] | Japan | 4-038164 |
| Oct. 26, 1992 | [JP] | Japan | 4-287530 |
| Oct. 27, 1992 | [JP] | Japan | 4-289117 |
| Nov. 13, 1992 | [JP] | Japan | 4-303974 |

[51] Int. Cl.[5] ..... B41M 5/035; B41M 5/38

[52] U.S. Cl. ..... 503/227; 428/195; 428/480; 428/704; 428/913; 428/914

[58] Field of Search ..... 8/471; 428/195, 913, 428/914, 480, 704; 503/227

[56] References Cited

U.S. PATENT DOCUMENTS

| | | | |
|---|---|---|---|
| 4,778,782 | 10/1988 | Ito et al. | 503/227 |
| 4,929,591 | 5/1990 | Egashira et al. | 503/227 |

FOREIGN PATENT DOCUMENTS

| | | | |
|---|---|---|---|
| 0261505 | 3/1988 | European Pat. Off. | 503/227 |
| 0431184 | 6/1991 | European Pat. Off. | 503/227 |
| 61-229594 | 10/1986 | Japan | 503/227 |
| 62-46689 | 2/1987 | Japan | 503/227 |
| 63-67188 | 3/1988 | Japan | 503/227 |
| 1-127387 | 5/1989 | Japan | 503/227 |
| 3-19893 | 1/1991 | Japan | 503/227 |

OTHER PUBLICATIONS

Database Japio, n0 89-229684, JP-A-1229684, Sep. 13, 1989.

Database Japio, n0 84-169883, JP-A-59169883, Sep. 25, 1984.

*Primary Examiner*—B. Hamilton Hess

*Attorney, Agent, or Firm*—Oblon, Spivak, McClelland, Maier & Neustadt

[57] ABSTRACT

A recording medium for sublimation type heat-sensitive transfer recording process is disclosed in which an image receiving layer constituting a resin composition containing a dyeable resin and at least one compound shown in Formula (1) is formed on a substrate surface. This recording medium for sublimation type heat-sensitive transfer recording process has extremely superior light resistance, and the image recorded on this recording medium suffers little fade out or discoloration as a result of exposure to light, so that this recording medium is expected to contribute greatly to the spread of video printers and the like.

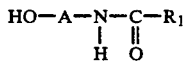

(1)

(In Formula (1), $R_1$ represents an alkyl group having a number of carbon atoms within a range of 1-20, and A represents a substituted or unsubstituted phenylene group or naphthalene group.)

13 Claims, No Drawings

RECORDING MEDIUM FOR SUBLIMATION TYPE HEAT-SENSITIVE TRANSFER RECORDING PROCESS

BACKGROUND OF THE INVENTION

Field of the Invention

The present invention relates to a recording medium for sublimation type heat-sensitive transfer recording process which forms a recorded image which has superior resistance to fading when exposed to light.

Background Art

Sublimation type heat-sensitive transfer recording process are advantageous in that the level of noise produced during recording is low, the apparatus used therefor is small and inexpensive, the maintenance thereof is easy, and the output time is short. Furthermore, since sublimation type dyes are used, by continuously varying the amount of the exothemic energy, high contrast recording may be easily achieved, and such recording exhibits high density and high resolution. As a result, in comparison with other recording methods, such a method is advantageous, especially for producing full color hard copy, and has been adopted as a recording method for color printers, video printers, and the like.

However, as the image recorded by means of such a sublimation type heat-sensitive transfer recording process is formed by means of sublimable dyes, the light resistance thereof is generally poor, and this is disadvantageous in that fade out and discoloration resulting from sunlight or fluorescent light exposure occurs easily. In order to solve this problem, an ultraviolet absorber or a photostabilizer was generally applied to the image receiving layer of the recording medium, and as a result of this, light resistance was somewhat improved; however, this improvement could not be termed sufficient. In addition, methods have been disclosed, such as that in Japanese Laid-Open Patent Application No. Hei 1-127387, in which a specified phenol antioxidant was applied to the image receiving layer, and that of Japanese Laid-Open Patent Application No. Hei 3-19893, and Japanese Laid-Open Patent Application No. Sho 61-229594, in which a specified phosphorus antioxidant was applied to the image receiving layer, and as a result of using these methods, a small increase in light resistance was observed; however, the degree of fade out and discoloration as a result of exposure to light was still large.

SUMMARY OF THE INVENTION

It is an object of the present invention to provide a recording medium for sublimation type heat-sensitive transfer recording process, the image recorded thereon having superior resistance to light exposure, and which exhibits a very low level of fade out and discoloration resulting from exposure to light.

The recording medium for sublimation type heat-sensitive transfer recording process in accordance with the present invention has formed, on the substrate surface thereof, an image receiving layer constituting a resin composition containing at least one of the compounds shown in Formula (1) below, and a dyeable resin.

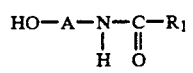

$$HO-A-\underset{\underset{H}{|}}{N}-\underset{\underset{O}{\|}}{C}-R_1 \quad (1)$$

(In Formula (1), $R_1$ represents an alkyl group having a number of carbon atoms within a range of 1–20, and A represents a substituted or unsubstituted phenylene group or naphthalene group.)

Furthermore, in accordance with the recording medium for sublimation type heat-sensitive transfer recording process in accordance with the present invention, by means of adding the compound shown in Formula (1) above to the image receiving layer, the light resistance is greatly increased, and the image which is recorded on this recording medium exhibits extremely low levels of fade out and discoloration resulting from exposure to light, so that this recording medium is expected to contribute greatly to the wider use of video printers, and the like.

DETAILED DESCRIPTION OF THE INVENTION

Examples of the substrate constituting the recording medium in accordance with the present invention include films or papers, for example, various plastic films, such as polyester film, polyethylene film, polypropylene film, polystyrene film, nylon film, vinyl chloride film, and the like or white films in which white pigment or filler has been added to one of these films; examples of papers include papers having cellulose fibers as the main component thereof such as recording paper, art paper, coated paper, and the like, and papers having plastic fibers as the main component thereof such as acrylic paper, polypropylene paper, polyester paper, and the like. These papers or films may be used without being subjected to preprocessing, or where necessary, preprocessing such as washing, etching, corona discharge, activating energy irradiation, dyeing, printing, or the like, may be carried out prior to use. Furthermore, a laminated substrate, in which two or more of the above substrates are laminated together, may also be used. The thickness of the substrate is not particularly restricted; however, a thickness in a range of 20–500 micrometers is preferable.

An image receiving layer is formed on at least one surface of the above substrate; this image receiving layer receives and develops the sublimable dye which is transferred from the transfer sheet. The medium constituting this image receiving layer is not particularly restricted, insofar as the medium is easily dyed by means of sublimable dyes, and does not cause blocking of the transfer sheet during recording; examples of such a medium include cellulose resins, such as methyl cellulose, ethyl cellulose, ethyl hydroxy cellulose, hydroxy ethyl cellulose, hydroxy propyl cellulose, cellulose acetate, and the like; vinyl resins such as polyvinyl alcohol, polyvinyl butylal, polyvinyl acetal, polyvinyl acetate, polyvinyl chloride, polyvinyl pyrolidone, styrene, and the like; acrylate resins, such as polymethyl (meth)acrylate, polybutyl (meth)acrylate, polyacrylamide, polyacrylonitrile, and the like; furthermore, polyester resin, polycarbonate resin, polyurethane resin, polyamide resin, urea resin, polycaprolactone resin, polyallylate resin, polysulfone resin, or copolymers or mixtures thereof, can be used as dyeable resins. Among these, polyester resin is easily dyed by means of sublimable dyes, and the image obtained has good storage stability, so that it is preferable that polyester resin be included as at least one component of the dyeable resin.

It is preferable to include a cross-linking component in the image receiving layer in accordance with the present invention, in order to increase the separability of the image receiving layer from the transfer sheet. For example, it is possible to include heat curable components such as isocyanate and polyol and the like, and to thermally cross-link these components after the formation of the image receiving layer, or to apply a cross-linking agent curable by means of activating energy rays, for example, a resin composition including monomers or oligomers possessing acryloyloxy groups or methacryloyloxy groups, to the surface of a substrate, and then to cure this by means of activating energy rays, thus yielding an image receiving layer. In particular, in the case of a method in which components which can be cross-linked by means of activated energy rays are blended, cured by means of activating energy rays, and an image receiving layer thus obtained, high productivity becomes possible, the surface gloss of the resulting image receiving layer is high, and the storage stability of the recorded image with respect to heat is high, so that such a method is more preferable.

The amount of the above dyeable resin and cross-linking components which are used are not particularly restricted; however, it is preferable that, with respect to a total amount of both the dyeable resin and the cross-linking components of 100 parts by weight, the dyeable resin be present in an amount of 40–95 parts by weight, while the cross-linking components be present in an amount of 60–5 parts by weight.

The resin composition containing a cross-linking agent curable by means of activating energy rays may be cured by activating energy rays such as an electron beam or ultraviolet radiation; however, in the case in which ultraviolet radiation is used as the activating energy rays, it is desirable to include a conventional photopolymerization initiator. The amount of photopolymerization initiator which is used is not particularly restricted; however, it is preferable that, with respect to a total amount of the above-described dyeable resin forming the image receiving layer and cross-linking components of 100 parts by weight, the photopolymerization initiator be present in an amount of 0.1–10 parts by weight.

In the present invention, in order to achieve an increase in the photoresistance of the image recorded on the image receiving layer, the most important condition is the inclusion, as stated above, of at least one of the compounds shown in Formula (1) below, in the resin composition forming the image receiving layer.

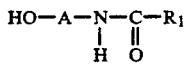

(1)

(In Formula (1), $R_1$ represents an alkyl group having a number of carbon atoms within a range of 1–20, and A represents a substituted or unsubstituted phenylene group or naphthalene group.)

By means of blending an extremely small amount of a compound possessing the specified structure described above into the resin composition forming the image receiving layer, the light resistance of the recorded image increases to an unexpected extent, in comparison with conventional resin compositions, and the fade out and discoloration resulting from exposure to light becomes extremely small.

The compounds shown in the following Structural Formulas (A) and (B) below are concrete examples of the compounds shown in Formula (1).

(A)

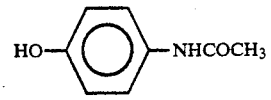

(B)

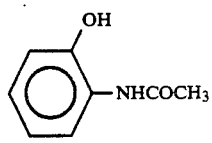

It is possible to use the compounds shown in Formula (1) singly or in a mixture of two or more. The amounts of these antioxidants which are used are not particularly restricted; however, with respect to 100 parts by weight of the dyeable resin or 100 parts by weight of the dyeable resin and cross linking components which form the image receiving layer, respectively, it is preferably that this antioxidant be present in an amount of 0.1–10 parts by weight, and more preferably in an amount of 0.3–5 parts by weight. If the amount used is too small, it is difficult to obtain the superior light resistance which is an object of the present invention, while when the amount used is too great, the antioxidant easily bleeds out of the surface of the light receiving layer, and the recorded image blurs easily over time.

In the present invention, by using, in addition to the compounds shown in Formula (1), at least one phosphite antioxidant having the specified structure shown in Formulas (2), (3), or (4) below, and blending this compound into the resin composition constituting the image receiving layer, it has been determined that the light resistance of the recorded image is further increased, and fade out and discoloration resulting from exposure to light is still further reduced.

(2)

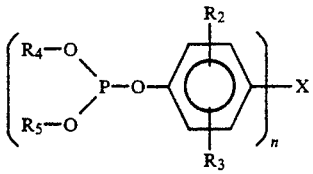

(In Formula (2), $R_2$ and $R_3$ represent H or an alkyl group having a number of carbon atoms within a range of 1–20, $R_4$ and $R_5$ represent an alkyl group having a number of carbon atoms within a range of 1–20, X represents H or an atomic group having 1–10 carbon atoms as a main skeleton thereof, and n has a value of 1, 2, 3, or 4.)

(3)

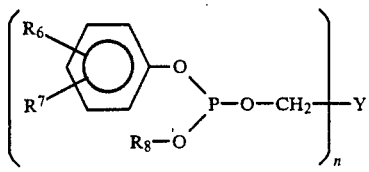

(In Formula (3), $R_6$ and $R_7$ represent H or an alkyl group having a number of carbon atoms within a range of 1–20, $R_8$ represents an alkyl group having a number of carbon atoms within a range of 1–20, Y represents H or an atomic group having 1–10 carbon atoms as a main skeleton thereof, and n has a value of 1, 2, 3, or 4.)

(4)

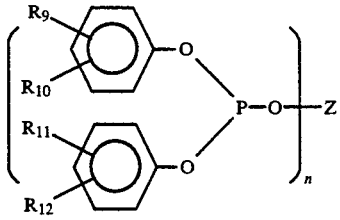

(In Formula (4), $R_9$, $R_{10}$, $R_{11}$, and $R_{12}$ represent H or an alkyl group having a number of carbon atoms within a range of 1–20, Z represents H or an atomic group having 1–10 carbon atoms as a main skeleton thereof, and n has a value of 1, 2, 3, or 4.)

The compounds shown in the following Structural Formulas (C)–(K) below are concrete examples of the compounds shown in Formulas (2), (3), and (4).

(C)

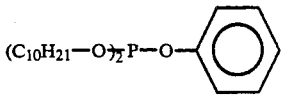

(D)

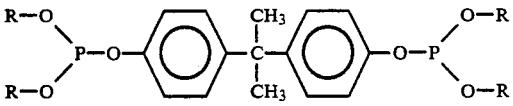

(R=an alkyl group having a number of carbon atoms within a range of 12-15)

(E)

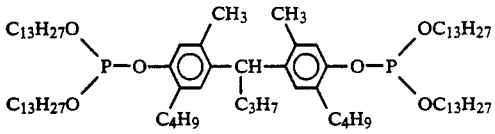

(F)

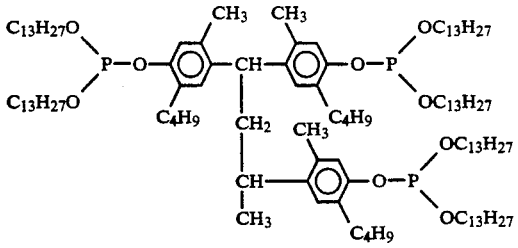

(G)

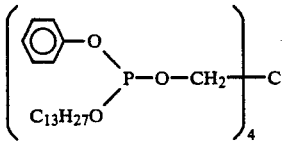

(H)

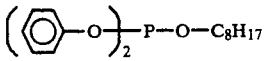

(I)

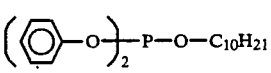

-continued (J)

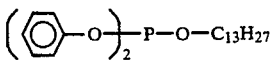

(K)

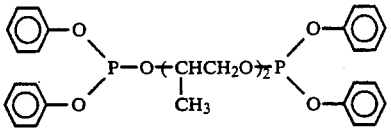

These phosphite antioxidants may be used singly, or two or more variants thereof may be mixed and used. The amounts of these antioxidants which are used are not particularly restricted; however, with respect to a total of 100 parts by weight of dyeable resin constituting the image receiving layer, or with respect to a total of 100 parts by weight of dyeable resin and cross-linking components constituting the image receiving layer, respectively, it is preferable that this antioxidant be present in an amount of 0.5–20 parts by weight, and preferably in an amount of 2–15 parts by weight. If the amount used thereof is too small, the superior light resistance which is an object of the present invention is difficult to obtain, while when the amount used thereof is too great, the antioxidant easily bleeds out onto the surface of the image receiving layer, and the recorded image thus tends to blur over time.

In the present invention, in order to further increase the light resistance of the image receiving layer, it is permissible to include an ultraviolet absorber in the resin composition constituting the image receiving layer, in addition to the compounds shown in Formulas (1)–(4) above.

It is possible to use conventional ultraviolet absorbers such as benzotriazole ultraviolet absorbers or benzophenone ultraviolet absorbers, or the like, as these ultraviolet absorbers. Concrete examples of benzotriazole ultraviolet absorbers include, for example, 2-(5-methyl-2-hydroxy phenyl) benzotriazole (manufactured by Ciba-Geigy: TINUVIN P), 2-[2-hydroxy-3,5-bis(α,α-dimethyl-benzyl) phenyl]-2H-benzotriazole (manufactured by Ciba-Geigy: TINUVIN 234), 2-(5-t-butyl-2-hydroxy phenyl) benzotriazole (manufactured by Ciba-Geigy: TINUVIN PS), 2-(3,5-di-t-butyl-2-hydroxy phenyl) benzotriazole (manufactured by Ciba-Geigy: TINUVIN 320), 2-(3-t-butyl-5-methyl-2-hydroxy phenyl)-5-chlorobenzotriazole (manufactured by Ciba-Geigy: TINUVIN 326), 2-(3,5-di-t-butyl-2-hydroxyphenyl)-5-chlorobenzotriazole (manufactured by Ciba-Geigy: TINUVIN 327), 2-(3,5-di-t-amyl-2-hydroxy phenyl) benzotriazole (manufactured by Ciba-Geigy: TINUVIN 328), 2-[2-hydroxy-3-(3,4,5,6-tetrahydrophthalimide methyl)-5-methyl phenyl]benzotriazole (manufactured by Sumitomo Chemical Company, Limited: SUMISORB 250), 2-(4-octoxy-2-hydroxyphenyl) benzotriazole, and the like. Concrete examples of the benzophenone ultraviolet absorber include, for example, 2,4-dihydroxybenzophenone, 2-hydroxy-4-methoxy benzophenone, 2-hydroxy-4-octoxybenzophenone, 2-hydroxy-4-dodecyloxybenzophenone, 2-hydroxy-4-benzyloxybenzophenone, 2,2'-dihydroxy-4-methoxy benzophenone, 2,2',4,4'-tetrahydroxy benzophenone, 2,2'-dihydroxy-4,4'-dimethoxybenzophenone, 2,2'-dihydroxy-4,4'-dioctoxy benzophenone, 2,2'-dihydroxy-4,4'-didodecyloxy benzophenone, 2-hydroxy-4-methoxy-5-sulfobenzophenone, and the like.

These ultraviolet absorbers may be used singly or in a mixture of two or more thereof. The amounts used thereof are not particularly restricted; however, with respect to a total of 100 parts by weight of dyeable resin, or with respect to a total of 100 parts by weight of dyeable resin and cross-linking components, the ultraviolet absorber may be preferably present in an amount of 1–10 parts by weight. If the amount used is too small, the effect of an increase in light resistance is insufficient, while when the amount used is too great, the ultraviolet absorber bleeds onto the surface of the image receiving layer, and the recorded image tends to blur over time.

Furthermore, in order to further increase the light resistance of the image receiving layer, it is acceptable to include a hindered amine photostabilizer in-the resin composition forming the image receiving layer. Conventional hindered amine photostabilizers may be used; concrete examples thereof include, for example, bis(2,2,6,6-tetramethyl-4-piperidyl) sebacate (manufactured by Sankyo Company, Limited: SANOL LS770), bis(1,2,2,6,6-pentamethyl-4-piperidyl) sebacate (manufactured by Sankyo Company, Limited: SANOL LS765), 1-{2-[([3-(3,5-di-t-butyl-4-hydroxy phenyl) propionyloxy] ethyl}-4-[3-(3,5-di-t-butyl-4-hydroxy phenyl) propionyloxy]-2,2,6,6-tetramethyl piperidine (manufactured by Sankyo Company, Limited: SANOL LS2626), 4-benzoyloxy-2,2,6,6-tetramethyl piperidine (manufactured by Sankyo Company, Limited: SANOL LS744), 8-acetyl-3-dodecyl-7,7,9,9-tetramethyl-1,3,8-triaza-spiro [4,5] decane-2,4-dione (manufactured by Sankyo Company, Limited: SANOL LS440), 2-(3,5-di-t-butyl-4-hydroxy benzyl)-2-n-butylmalonate bis (1,2,2,6,6-pentamethyl-4-piperidyl) (manufactured by Ciba-Geigy: TINUVIN 144), succinate bis(2,2,6,6-tetramethyl-4-piperidinyl) ester (manufactured by Ciba-Geigy: TINUVIN 780 FF), a condensation polymer of dimethyl succinate and 1-(2-hydroxy ethyl)-4-hydroxy-2,2,6,6-tetramethyl piperidine (manufactured by Ciba-Geigy: TINUVIN 622 LD), poly{[6-(1,1,3,3-tetramethylbutyl) amino-1,3,5-triazine-2,4-dyl] [(2,2,6,6-tetramethyl-4-piperidyl) imino]hexamethylene [(2,2,6,6-tetramethyl-4-piperidyl) imino]} (manufactured by Ciba-Geigy: CHIMASSORB 944LD), a condensation polymer of N,N'-bis(3-aminopropyl) ethylene diamine and 2,4-bis[N-butyl-N-(1,2,2,6,6-pentamethyl-4-piperidyl) amino]-6-chloro-1,3,5-triazine (manufactured by Ciba-Geigy: CHIMASSORB 119FL), HA-70G (manufactured by Sankyo Company, Limited), ADK STAB LA-52, ADK STAB LA-57, ADK STAB LA-62, ADK STAB LA-67, ADK STAB LA-63, ADK STAB LA-68, ADK STAB LA-82, ADK STAB LA-87 (all produced by Asahi Denka Kogyo K.K.), and the like.

These hindered amine photostabilizers may be used singly or in a mixture of two or more; however, when the effect of an increase in light resistance is taken into account, it is preferable that they be used in concert with the above-described ultraviolet absorbers. The amounts used of these hindered amine photostabilizers is not particularly restricted; however, with respect to a total of 100 parts by weight of dyeable resin, or with respect to a total of 100 parts by weight of dyeable resin and cross-linking components, it is preferable that the hindered amine photostabilizer be present in an amount of 1–10 parts by weight. If the amount used is too small, the effect of an increase in light resistance cannot be sufficiently attained, while on the other hand, when the amount used is too large, the hindered amine photostabilizer tends to bleed out onto the surface of the image receiving layer, and thus the recorded image tends to blur over time.

Furthermore, it is permissible to include a releasing agent in the image receiving layer in accordance with the present invention in order to further increase the separability of the image receiving layer from the transfer sheet. Examples of this releasing agent include silicone surfactants, fluorine surfactants, a graft polymer using polyorganosiloxane as a trunk or a branch, silicon or fluorine compounds produciable a cross-linked structure, for example, a combination of amino-denatured silicon and epoxy-denatured silicon, and the like; the releasing agents may be used singly or concurrently. The amount of the releasing agent used is not particularly restricted; however, with respect to a total of 100 parts by weight of dyeable resin, or with respect to a total of 100 parts by weight of dyeable resin and cross-linking components, it is preferable that the releasing agent be present in an amount of 0.01–30 parts by weight.

Furthermore, depending on the purpose of use, inorganic fillers such as silica, calcium carbonate, titanium oxide, zinc oxide, and the like, may be included in the above resin compositions.

In manufacturing the recording medium of the present invention, the resin composition may be applied directly to a substrate surface by means of a coating method such as roll coating, bar coating, blade coating, or the like, and the image receiving layer can thus be formed. However, in order to increase the efficiency of the application process, the resin composition may be blended with a solvent able to dissolve the resin composition, such as, for example, ethyl alcohol, methylethylketone, toluene, ethyl acetate, dimethyl formamide, tetrahydrofuran, and the like, and appropriate adjustment of the application viscosity may be carried out. By means of this, application may easily be conducted by means of spray coating, curtain coating, flow coating, dip coating, or the like. In the case in which such solvents are blended with the resin composition, the solvents must be volatilized and dried after the application of the resin composition.

The image receiving layer preferably have a thickness of 0.5–100 micrometers, and more preferably within a range of 1–50 micrometers. At a thickness of less than 0.5 micrometers, the high recording density will not be obtained.

Furthermore, the recording medium in accordance with the present invention may have a layer such as an adhesion facilitating layer, an electrostatic prevention layer, a whiteness improving layer, or a compound layer combining these functions provided between the image receiving layer and the substrate. In addition, in this recording medium in accordance with the present invention, processing such as electrostatic prevention processing, contaminant protection processing, smoothing processing, and writing facilitation processing may be carried out on the side opposite the image receiving layer.

EXAMPLES

Hereinbelow, the present invention will be explained in detail based on examples.

In the following Examples and Comparative Examples, Part(s) means part(s) by weight, respectively.

EXAMPLE 1

On one side of a sheet of art paper (thickness 85 micrometers), a white polyester film (manufactured by Diafoil Hoechst: W900, thickness 38 micrometers) was laminated, and on the other side of this paper, a sheet of white polypropylene paper (manufactured by Oji Yuka: Yupo FPG, thickness 60 micrometers) was laminated, and a substrate was thus obtained. The AD-577-1 and the CAT-52 adhesives produced by Toyo Morton Co., Ltd. were used as the adhesives therefor.

The coating fluid for the image receiving layer described hereinbelow was coated uniformly to the surface of the white polyester film of the substrate thus obtained, by means of an immersion method, and after the volatilization of the solvent, this was irradiated with ultraviolet rays by means of a high pressure mercury lamp, and an image receiving layer having a thickness of 5–6 micrometers was formed, so that a recording medium was obtained.

| Coating Fluid for Image Receiving Layer | |
|---|---|
| Polyester resin formed from the condensation polymerization of terephthalic acid / isophthalic acid / ethylene glycol / neopenthyl glycol (molecular weight 15000–20000, glass transition temperature 67° C.) | 20 parts |
| Polyester resin formed from the condensation polymerization of terephthalic acid / isophthalic acid / sebacic acid / ethylene glycol / neopenthyl glycol / 1,4-butane diol (molecular weight 18000–20000, glass transition temperature 47° C.) | 50 parts |
| Kayarad DPHA (produced by Nippon Kayaku Co., Ltd) | 15 parts |
| 2,2-bis(4-acryloyloxy diethoxy phenyl) propane | 15 parts |
| 1-hydroxycyclohexylphenyl ketone | 3 parts |
| Compound expressed in Structual Formura (A) avobe (p-acetoamide phenol) | 0.6 parts |
| 2-hydroxy-4-octoxybenzophenone | 4.8 parts |
| Bis(1,2,2,6,6-pentamethyl-4-piperidyl) sebacate | 4.8 parts |
| Silicon surfactant expressed in Structural Formula (5) below | 0.5 part |

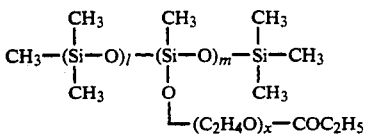

(5)

$$\left(\frac{2l + m + 1}{mx} = 1.3\right)$$

| | |
|---|---|
| Methylethyl ketone | 500 parts |
| Toluene | 100 parts |

The recording medium which was thus obtained was used for recording using the cyan color and the magenta color of the color sheet VW-VS 100 for the NV-MP1 video printer produced by Matsushita Electric Industrial Co., Ltd, and using a thermal head produced by Kyocera Corporation (950 Ohms, 6 dots/mm) and under conditions such that the recording voltage was 13V, and the pulse width was 10 msec. Subsequently, the recorded image was exposed for a period of 72 hours using a xenon long life fade meter (produced by Suga Test Instruments Co., Ltd.: model FAL-25AX) and the color variation (ΔE) before and after exposure was measured. The results thereof are shown in Table 1.

EXAMPLE 2

In Example 2, a process was followed which was identical to that of Example 1, with the exception that the amount of use of the compound (A) (p-acetamido phenol) was set at a level of 1.3 parts, and a recording medium was obtained.

The recording medium which was thus obtained was tested in the same manner as in Example 1, and ΔE was measured. The results thereof are shown in Table 1.

EXAMPLE 3

In Example 3, a process was followed which was identical to that of Example 1, with the exception that the amount of use of the compound (A) (p-acetamid phenol) was set at a level of 2.0 parts, and a recording medium was obtained.

The recording medium which was thus obtained was tested in the same manner as in Example 1, and ΔE was measured. The results thereof are shown in Table 1.

EXAMPLE 4

In Example 4, a process was followed which was identical to that of Example 1, with the exception that the amount of use of the compound (A) (p-acetoamide phenol) was set at a level of 4.0 parts, and 600 parts of tetrahydrofuran was used as a solvent, and a recording medium was obtained.

The recording medium which was thus obtained was tested in the same manner as in Example 1, and ΔE was measured. The results thereof are shown in Table 1.

EXAMPLE 5

In Example 5, a process was followed which was identical to that of Example 1, with the exception that in place of the compound (A) (p-acetamido phenol) which was used in Example 1, 1.0 parts of the compound expressed in Structural Formula (B) (o-acetamido phenol) was used, and a recording medium was obtained.

The recording medium which was thus obtained was tested in the same manner as in Example 1, and ΔE was measured. The results thereof are shown in Table 1.

EXAMPLE 6

The coating fluid for the image receiving layer described hereinbelow was uniformly coated to the surface of white polyester film surface comprising the substrate used in Example 1, by means of an immersion method, and the solvent was volatilized, and subsequently, this was heated for a period of 2 hours at a temperature of 100° C., and an image receiving layer having a thickness of 5–6 micrometers was formed, so that a recording medium was obtained.

| Coating Fluid for the Image Receiving Layer | |
|---|---|
| Polyester resin formed by the condensation polymerization of terephthalic acid/ isophthalic acid/ethylene glycol/neopenthyl glycol (molecular weight 15000–20000, glass transition temperature 67° C.) | 24 parts |
| Polyester resin formed by the condensation polymerization of terephthalic acid/ isophthalic acid/sebacic acid/ethylene glycol/neopenthyl glycol/1,4-butane diol (molecular weight 18000–20000, glass transition temperature 47° C.) | 60 parts |
| Amino-denatured silicone oil (produced by Shin-Etsu Chemical Co., Ltd.: KF-393) | 8 parts |
| Epoxy-denatured silicone oil (produced by | 8 parts |

-continued

| Coating Fluid for the Image Receiving Layer | |
|---|---|
| Shin-Etsu Chemical Co., Ltd.: X-22-343) | |
| Compound expressed by Structural Formula (A) above (p-acetoamide phenol) | 2.6 parts |
| Methylethyl ketone | 300 parts |
| Toluene | 300 parts |

The recording medium which was obtained was tested in the same manner as in Example 1, and ΔE was measured. The results are shown in Table 1.

EXAMPLE 7

In Example 7, a process was followed which was identical to that of Example 6, with the exception that in place of the compound (A) (p-acetamido phenol) which was used in Example 6, 2.6 parts of the compound expressed by Structural Formula (B) (o-acetamido phenol) was used, and a recording medium was obtained.

The recording medium which was thus obtained was tested in the same manner as in Example 1, and ΔE was measured. The results thereof are shown in Table 1.

COMPARATIVE EXAMPLE 1

In Comparative Example 1, a process was followed which was identical to that of Example 1, with the exception that the compound (A) (p-acetamido phenol) was not used, and a recording medium was obtained.

The recording medium which was thus obtained was tested in the same manner as in Example 1, and ΔE was measured. The results thereof are shown in Table 1.

COMPARATIVE EXAMPLE 2

In Comparative Example 2, a process was followed which was identical to that of Example 1, with the exception that in place of the compound (A) (p-acetamido phenol) which was used in Example 1, 2.0 parts of the antioxidant expressed by the Structural Formula (6) below (produced by Asahi Denka Kogyo K.K.: ADK STAB AO-75) was used, and a recording medium was obtained.

The recording medium which was thus obtained was tested in the same manner as in Example 1, and ΔE was measured. The results thereof are shown in Table 1.

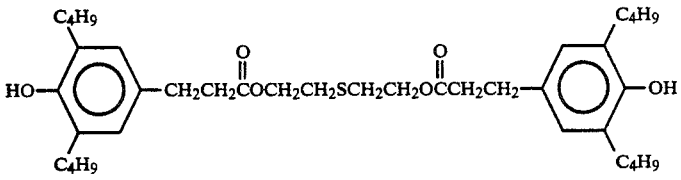

(6)

COMPARATIVE EXAMPLE 3

In Comparative Example 3, a process was followed which was identical to that of Example 1, with the exception that in place of the compound (A) (p-acetamido phenol) which was used in Example 1, 2.0 parts of the antioxidant expressed by the Structural Formula (7) below (produced by Sumitomo Chemical Company, Limited: Sumilizer BP-101) was used, and a recording medium was obtained.

The recording medium which was thus obtained was tested in the same manner as in Example 1, and ΔE was measured. The results thereof are shown in Table 1.

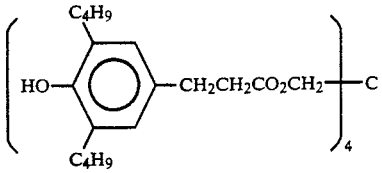

(7)

COMPARATIVE EXAMPLE 4

In Comparative Example 4, a process was followed which was identical to that of Example 1, with the exception that in place of the compound (A) (p-acetamido phenol) which was used in Example 1, 2.0 parts of the antioxidant expressed by the Structural Formula (8) below (produced by Sumitomo Chemical Company, Limited: Sumilizer TNP) was used, and a recording medium was obtained.

The recording medium which was thus obtained was tested in the same manner as in Example 1, and ΔE was measured. The results thereof are shown in Table 1.

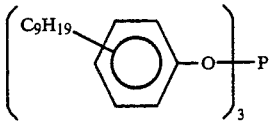

(8)

COMPARATIVE EXAMPLE 5

In Comparative Example 5, a process was followed which was identical to that of Example 1, with the exception that in place of the compound (A) (p-acetamido phenol) which was used in Example 1, 2.0 parts of the antioxidant expressed by the Structural Formula (9) below (produced by Sumitomo Chemical Company, Limited: Sumilizer TPP-R) was used, and a recording medium was obtained.

The recording medium which was thus obtained was tested in the same manner as in Example 1, and ΔE was measured. The results thereof are shown in Table 1.

(9)

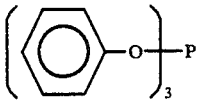

COMPARATIVE EXAMPLE 6

In Comparative Example 6, a process was followed which was identical to that of Example 1, with the exception that in place of the compound (A) (p-acetamido phenol) which was used in Example 1, 2.0 parts of the antioxidant expressed by the Structural Formula (10) below (produced by Sumitomo Chemical Company, Limited: Sumilizer P-16) was used, and a recording medium was obtained.

The recording medium which was thus obtained was tested in the same manner as in Example 1, and ΔE was measured. The results thereof are shown in Table 1.

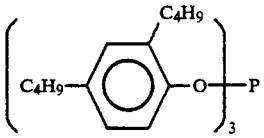
(10)

COMPARATIVE EXAMPLE 7

In Comparative Example 7, a process was followed which was identical to that of Example 1, with the exception that in place of the compound (A) (p-acetamido phenol) which was used in Example 1, 2.0 parts of the antioxidant expressed by the Structural Formula (11) below (produced by Sakai Chemical Industry Co., Ltd.: CHELEX-PC) was used, and a recording medium was obtained.

The recording medium which was thus obtained was tested in the same manner as in Example 1, and ΔE was measured. The results thereof are shown in Table 1.

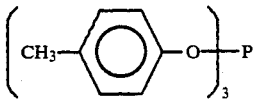
(11)

COMPARATIVE EXAMPLE 8

In Comparative Example 8, a process was followed which was identical to that of Example 1, with the exception that in place of the compound (A) (p-acetamido phenol) which was used in Example 1, 2.0 parts of the antioxidant expressed by the Structural Formula (12) below (produced by Asahi Denka Kogyo K.K.: ADK STAB PEP-4C) was used, and a recording medium was obtained.

The recording medium which was thus obtained was tested in the same manner as in Example 1, and ΔE was measured. The results thereof are shown in Table 1.

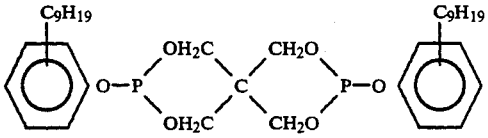
(12)

COMPARATIVE EXAMPLE 9

In Comparative Example 9, a process was followed which was identical to that of Example 1, with the exception that in place of the compound (A) (p-acetamido phenol) which was used in Example 1, 2.0 parts of the antioxidant expressed by the Structural Formula (13) below (produced by Asahi Denka Kogyo K.K.: ADK STAB 3010) was used, and a recording medium was obtained.

The recording medium which was thus obtained was tested in the same manner as in Example 1, and ΔE was measured. The results thereof are shown in Table 1.

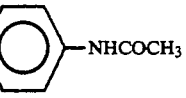
(13)

COMPARATIVE EXAMPLE 10

In Comparative Example 10, a process was followed which was identical to that of Example 1, with the exception that in place of the compound (A) (p-acetamido phenol) which was used in Example 1, 1.0 parts of the compound expressed by the Structural Formula (14) below (acetanilide) was used, and a recording medium was obtained.

The recording medium which was thus obtained was tested in the same manner as in Example 1, and ΔE was measured. The results thereof are shown in Table 1.

(14)

COMPARATIVE EXAMPLE 11

In Comparative Example 11, a process was followed which was identical to that of Example 1, with the exception that in place of the compound (A) (p-acetamido phenol) which was used in Example 1, 1.0 parts of the compound expressed by the Structural Formula (15) below (N-carbamyl-m-aminophenol) was used, and a recording medium was obtained.

The recording medium which was thus obtained was tested in the same manner as in Example 1, and ΔE was measured. The results thereof are shown in Table 1.

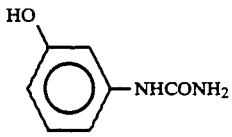
(15)

COMPARATIVE EXAMPLE 12

In Comparative Example 12, a process was followed which was identical to that of Example 1, with the exception that in place of the compound (A) (p-acetoamide phenol) which was used in Example 1, 1.0 parts of the compound expressed by the Structural Formula (16) below (p-hydroxybenzoate-n-butyl ester) was used, and a recording medium was obtained.

The recording medium which was thus obtained was tested in the same manner as in Example 1, and ΔE was measured. The results thereof are shown in Table 1.

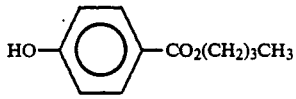
(16)

As is clear from Table 1, the color variation (ΔE) of the recording materials of Examples 1–7 was markedly smaller than that of Comparative Examples 1–12.

EXAMPLE 8

The coating fluid for the image receiving layer described hereinbelow was coated uniformly to the surface of white polyester film surface comprising the substrate used in Example 1, by means of an immersion method, and the solvent was volatilized, and subsequently, this was irradiated with ultraviolet rays by means of a high pressure mercury lamp, and an image receiving layer having a thickness of 5–6 micrometers was formed, and thus a recording medium was obtained.

| Coating Fluid for the Image Receiving Layer | |
|---|---|
| Polyester resin formed by the condensation polymerization of terephthalic acid/isophthalic acid/ethylene glycol/neopenthyl glycol (molecular weight 15000–20000, glass transition temperature 67° C.) | 20 parts |
| Polyester resin formed by the condensation polymerization of terephthalic acid/isophthalic acid/sebacic acid/ethylene glycol/neopenthyl glycol/1,4-butane diol (molecular weight 18000–20000, glass transition temperature 47° C.) | 50 parts |
| Kayarad DPHA (Produced by Nippon Kayaku Co., Ltd) | 15 parts |
| 2,2-bis (4-acryloyl oxydiethoxyphenyl) propane | 15 parts |
| 1-hydroxycyclohexylphenyl ketone | 3 parts |
| Compound expressed by Structural Formula (A) above (p-acetamido phenol) | 1.3 parts |
| Phosphite antioxidant expressed by Structural Formula (C) above (produced by Asahi Denka Kogyo K.K.: ADK STAB 517) | 4.8 part |
| 2-hydroxy-4-octoxybenzophenone | 4.8 parts |
| Bis (1,2,2,6,6-pentamethyl-4-piperidyl) sebacate | 4.8 parts |
| Silicon surfactant expressed by Structural Formula (5) above | 0.5 part |
| Methylethyl ketone | 500 parts |
| Toluene | 100 parts |

The recording medium which was thus obtained was used for recording by means of a thermal head (950 ohms, 6 dots/mm) produced by Kyocera Corporation and using the cyan color of a VW-VS 100 color sheet for use in an NV-MP 1 video printer produced by Matsushita Electric Industrial Co., Ltd., under conditions such that the recording voltage was 13V, and the pulse width was 10 msec. Subsequently, the recorded image was exposed for a period of 72 hours using a xenon long life fade meter (produced by Suga Test Instruments Co., Ltd.: model FAL-25AX), and the color variation (ΔE) before and after exposure was measured. The results are shown in Table 2.

EXAMPLE 9

In Example 9, a process identical to that of Example 8 was followed, with the exception that the amount of use of compound (A) (p-acetamido phenol) was set at a level of 1.6 parts, and the amount of use of phosphite antioxidant (C) (ADK STAB 517) was set at a level of 6.5 parts, and a recording medium was obtained.

The recording medium which was thus obtained was tested in the same manner as in Example 8, and ΔE was measured. The results thereof are shown in Table 2.

EXAMPLE 10

In Example 10, a process identical to that of Example 8 was followed, with the exception that the amount of use of compound (A) (p-acetamido phenol) was set at a level of 2.0 parts, and the amount of use of phosphite antioxidant (C) (ADK STAB 517) was set at a level of 8.0 parts, and a recording medium was obtained.

The recording medium which was thus obtained was tested in the same manner as in Example 8, and ΔE was measured. The results thereof are shown in Table 2.

EXAMPLE 11

In Example 11, a process identical to that of Example 8 was followed, with the exception that the amount of use of compound (A) (p-acetamid phenol) was set at a level of 0.6 parts, and in place of phosphite antioxidant (C) (ADK STAB 517), 6.8 parts of the phosphite antioxidant expressed in Structural Formula (G) above (produced by Johoku Chemical Co., Ltd.: JPP-613M) was used, and a recording medium was obtained.

The recording medium which was thus obtained was tested in the same manner as in Example 8, and ΔE was measured. The results thereof are shown in Table 2.

EXAMPLE 12

In Example 12, a process identical to that of Example 8 was followed, with the exception that the amount of use of compound (A) (p-acetamido phenol) was set at a level of 0.6 parts, and in place of phosphite antioxidant (C) (ADK STAB 517), 6.8 parts of the phosphite antioxidant expressed in Structural Formula (H) above (produced by Asahi Denka Kogyo K.K.: ADK STAB C) was used, and a recording medium was obtained.

The recording medium which was thus obtained was tested in the same manner as in Example 8, and ΔE was measured. The results thereof are shown in Table 2.

EXAMPLE 13

In Example 13, a process identical to that of Example 8 was followed, with the exception that the amount of use of compound (A) (p-acetamido phenol) was set at a level of 0.6 parts, and in place of phosphite antioxidant (C) (ADK STAB 517), 7.1 parts of the phosphite antioxidant expressed in Structural Formula (I) above (produced by Johoku Chemical Co., Ltd.: JPM-311) was used, and a recording medium was obtained.

The recording medium which was thus obtained was tested in the same manner as in Example 8, and ΔE was measured. The results thereof are shown in Table 2.

EXAMPLE 14

In Example 14, a process identical to that of Example 8 was followed, with the exception that the amount of use of compound (A) (p-acetamido phenol) was set at a level of 0.6 parts, and in place of phosphite antioxidant (C) (ADK STAB 517), 8.0 parts of the phosphite antioxidant expressed in Structural Formula (J) above (produced by Johoku Chemical Co.,Ltd.: JPM-313) was used, and a recording medium was obtained.

The recording medium which was thus obtained was tested in the same manner as in Example 8, and ΔE was-measured. The results thereof are shown in Table 2.

EXAMPLE 15

In Example 15, a process identical to that of Example 8 was followed, with the exception that in place of the two types of polyester resins which were used in Example 8, 70 parts of a polyester resin obtained by the condensation polymerization of terephthalic acid/isophthalic acid/ethylene glycol/neopenthyl glycol/1,4-cyclohexane dimethanol (molecular weight 25000–30000, glass transition temperature 67° C.) was used, the amount of use of compound (A) (p-acetamido phenol) was set at a level of 1.0 parts, and in place of phosphite antioxidant (C) (ADK STAB 517), 8.0 parts of the phosphite antioxidant expressed in Structural Formula (H) above (produced by Asahi Denka Kogyo K.K.: ADK STAB C) was used, and a recording medium was obtained.

The recording medium which was thus obtained was tested in the same manner as in Example 8, and AE was measured. The results thereof are shown in Table 2.

EXAMPLE 16

In Example 16, a process identical to that of Example 15 was followed, with the exception that the amount of use of compound (A) (p-acetamido phenol) was set at a level of 2.0 parts, and a recording medium was obtained.

The recording medium which was thus obtained was tested in the same manner as in Example 8, and ΔE was measured. The results thereof are shown in Table 2.

As is clear from Table 2, the recording materials of Examples 8–16, in which phosphite antioxidants having the specified structures shown in Formulas (2), (3), or (4) above were used concurrently with the compound having the specified structure shown in Formula (1) above, had color variances (ΔE) which were further reduced.

TABLE 1

| Number | COMPOUND | AMOUNT ADDED | ΔE (CYAN) | ΔE (MAGENTA) |
|---|---|---|---|---|
| Example 1 | p-acetoamide phenol | 0.6 | 13.1 | 14.0 |
| Example 2 | p-acetoamide phenol | 1.3 | 11.6 | 12.4 |
| Example 3 | p-acetoamide phenol | 2.0 | 11.0 | 10.3 |
| Example 4 | p-acetoamide phenol | 4.0 | 10.5 | 9.7 |
| Example 5 | o-acetoamide phenol | 1.0 | 10.9 | 13.3 |
| Example 6 | p-acetoamide phenol | 2.6 | 10.5 | 13.4 |
| Example 7 | o-acetoamide phenol | 2.6 | 9.9 | 15.1 |
| Comparative Example 1 | NONE | — | 20.0 | 18.0 |
| Comparative Example 2 | ADK STAB AO-75 | 2.0 | 19.0 | 18.1 |
| Comparative Example 3 | SUMILIZER BP-101 | 2.0 | 19.3 | 19.2 |
| Comparative Example 4 | SUMILIZER TNP | 2.0 | 18.1 | 17.0 |
| Comparative Example 5 | SUMILIZER TPP-R | 2.0 | 17.0 | 16.8 |
| Comparative Example 6 | SUMILIZER P-16 | 2.0 | 18.6 | 18.9 |
| Comparative Example 7 | CHELEX-PC | 2.0 | 18.9 | 17.8 |
| Comparative Example 8 | ADK STAB PEP-4C | 2.0 | 19.2 | 18.0 |
| Comparative Example 9 | ADK STAB 3010 | 2.0 | 19.5 | 17.9 |
| Comparative Example 10 | acetoamide | 1.0 | 15.5 | 20.7 |
| Comparative Example 11 | N-carbamyl-m-aminophenol | 1.0 | 17.0 | 24.3 |
| Comparative Example 12 | p-hydroxybenzoate-n-butylester | 1.0 | 17.6 | 21.2 |

TABLE 2

| Number | COMPOUND (A) | (AMOUNT ADDED) | phosphite antioxidant | (AMOUNT ADDED) | ΔE |
|---|---|---|---|---|---|
| Example 8 | p-acetoamide phenol | (1.3) | ADK STAB 517 | (4.8) | 9.8 |
| Example 9 | p-acetoamide phenol | (1.6) | ADK STAB 517 | (6.5) | 7.9 |
| Example 10 | p-acetoamide phenol | (2.0) | ADK STAB 517 | (8.0) | 6.4 |
| Example 11 | p-acetoamide phenol | (0.6) | JPP-613 M | (6.8) | 8.9 |
| Example 12 | p-acetoamide phenol | (0.6) | ADK STAB C | (6.8) | 8.0 |
| Example 13 | p-acetoamide phenol | (0.6) | JPM-311 | (7.1) | 8.8 |
| Example 14 | p-acetoamide phenol | (0.6) | JPM-313 | (8.0) | 7.5 |
| Example 15 | p-acetoamide phenol | (1.0) | ADK STAB C | (8.0) | 7.3 |
| Example 16 | p-acetoamide phenol | (2.0) | ADK STAB C | (8.0) | 6.0 |

What is claimed is:

1. A recording medium for sublimation heat-sensitive transfer recording process, wherein an image receiving layer constituting a resin composition containing dyeable resin and at least one member selected from the group consisting of compounds shown in Formula (1) below, is formed on a substrate:

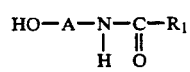

(1)

wherein $R_1$ represents an alkyl group having a number of carbon atoms within a range of 1–20, and A represents a substituted or unsubstituted phenylene group or naphthalene group.

2. A recording medium for sublimation heat-sensitive transfer recording process according to claim 1, wherein said resin composition constituting said image receiving layer furthermore contains at least one member selected from the group of phosphite antioxidants shown in Formulas (2), (3), and (4) below:

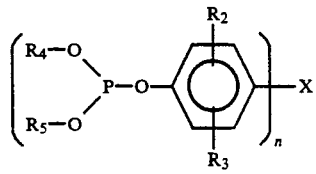

(2)

wherein $R_2$ and $R_3$ represent H or an alkyl group having a number of carbon atoms within a range of 1–20, $R_4$ and $R_5$ represent an alkyl group having a number of carbon atoms within a range of 1-20, X represents H or an atomic group having 1-10 carbon atoms as a main skeleton thereof, and n has a value of 1, 2, 3, or 4;

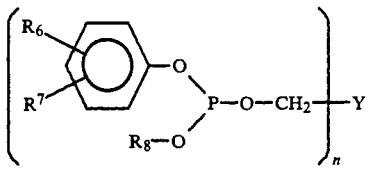

(3)

wherein $R_6$ and $R_7$ represent H or an alkyl group having a number of carbon atoms within a range of 1-20, $R_8$ represents an alkyl group having a number of carbon atoms within a range of 1-20, Y represents H or an atomic group having 1-10 carbon atoms as a main skeleton thereof, an n has a value of 1, 2, 3, or 4;

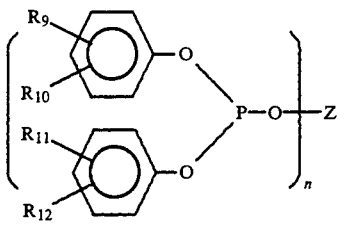

(4)

wherein $R_9$, $R_{10}$, $R_{11}$ and $R_{12}$ represent H or an alkyl group having a number of carbon atoms within a range of 1-20, Z represents H or a non-cyclic atomic group having 1-10 carbon atoms as a main skeleton thereof, and n has a value of 1, 2, 3, or 4.

3. A recording medium for sublimation heat-sensitive transfer recording process according to claim 1 or claim 2, wherein said resin composition constituting said image receiving layer contains polyester resin as at least one component of said dyeable resin.

4. A recording medium for sublimation heat-sensitive transfer recording process according to claim 1 or claim 2, wherein said resin composition constituting said image receiving layer contains at least one cross-linking component.

5. A recording medium for sublimation heat-sensitive transfer recording process according to claim 4, wherein an amount of said cross-linking component is such that with respect to a total amount of said dyeable resin and said cross-linking component of 100 parts by weight, said dyeable resin is present in an amount of 40-95 parts by weight, while said cross-linking component is present in an amount of 60-5 parts by weight.

6. A recording medium for sublimation heat-sensitive transfer recording process according to claim 4, wherein an amount of at least one member selected from the group consisting of compounds shown in Formula (1) is such that, with respect to a total amount of said dyeable resin and said cross-linking component constituting said image receiving layer of 100 parts by weight, said compound is present in an amount of 0.1-10 parts by weight.

7. A recording medium for sublimation heat-sensitive transfer recording process according to claim 4, wherein an amount of at least one member selected from the group consisting of compounds shown in Formula (1) is such that, with respect to a total amount of said dyeable resin and said cross-linking component constituting said image receiving layer of 100 parts by weight, said compound is present in an amount of 0.3-5 parts by weight.

8. A recording medium for sublimation heat-sensitive transfer recording process according to claim 4, wherein an amount of at least one member selected from the group consisting of compounds shown in Formulas (2), (3), and (4) is such that, with respect to a total amount of said dyeable resin and said cross-linking component constituting said image receiving layer of 100 parts by weight, said compound is present in an amount of 0.5-20 parts by weight.

9. A recording medium for sublimation heat-sensitive transfer recording process according to claim 4, wherein an amount of at least one member selected from the group consisting of compounds shown in Formulas (2), (3), and (4) is such that, with respect to a total amount of said dyeable resin and said cross-linking component constituting said image receiving layer of 100 parts by weight, said compound is present in an amount of 2-15 parts by weight.

10. A recording medium for sublimation heat-sensitive transfer recording process according to claim 1, wherein an amount of at least one member selected from the group consisting of compounds shown in Formula (1) is such that, with respect to a total amount of said dyeable resin constituting said image receiving layer of 100 parts by weight, said compound is present in an amount of 0.1-10 parts by weight.

11. A recording medium for sublimation heat-sensitive transfer recording process according to claim 1, wherein an amount of at least one member selected from the group consisting of compounds shown in Formula (1) is such that, with respect to a total amount of dyeable resin constituting said image receiving layer of 100 parts by weight, said compound is present in an amount of 0.3-5 parts by weight.

12. A recording medium for sublimation heat-sensitive transfer recording process according to claim 1, wherein an amount of at least one member selected from the group consisting of compounds shown in Formulas (2), (3), and (4) is such that, with respect to 100 parts by weight of said dyeable resin constituting said image receiving layer, said compound is present in an amount of 0.5-20 parts by weight.

13. A recording medium for sublimation heat-sensitive transfer recording process according to claim 1, wherein an amount of at least one member selected from the group consisting of compounds shown in Formulas (2), (3), and (4) is such that, with respect to 100 parts by weight of said dyeable resin constituting said image receiving layer, said compound is present in an amount of 2-15 parts by weight.

* * * * *